US006546612B2

(12) United States Patent
Ollendick et al.

(10) Patent No.: US 6,546,612 B2
(45) Date of Patent: Apr. 15, 2003

(54) PRE-PLATING OF WOODEN RAILROAD TIES

(76) Inventors: Robert Ollendick, 5 Alta Vista, Rio Vista Hills, Wickenburg, AZ (US) 85258; David Ollendick, P.O. Box 1848, Ogden, UT (US) 84402

( * ) Notice: Subject to any disclaimer, the term of this patent is extended or adjusted under 35 U.S.C. 154(b) by 0 days.

(21) Appl. No.: 09/888,794

(22) Filed: Jun. 25, 2001

(65) Prior Publication Data

US 2001/0034933 A1 Nov. 1, 2001

Related U.S. Application Data

(62) Division of application No. 09/322,280, filed on May 28, 1999, now Pat. No. 6,292,997.

(51) Int. Cl.[7] ..... B21D 39/03
(52) U.S. Cl. ..... 29/430; 104/16; 238/288
(58) Field of Search ..... 238/338, 304, 238/347, 339, 348, 321, 288, 349; 269/25, 246, 245, 37; 29/464, 432, 430, 281.5; 104/16, 17.1; 33/526, 527, 651, 1 Q, 287

(56) References Cited

U.S. PATENT DOCUMENTS 680,542 A * 8/1901 Peter
825,171 A * 3/1906 Anderson
923,004 A * 5/1909 Bennett
936,004 A * 10/1909 Martin
941,264 A * 11/1909 Ohe
988,174 A * 3/1911 Counts
1,051,405 A * 1/1913 Hilton
1,114,970 A * 10/1914 Cumner ..... 269/245
1,115,202 A * 10/1914 Ingles
1,150,962 A * 8/1915 Pederson
1,230,370 A * 6/1917 Bender
1,563,466 A * 7/1925 Bujol
1,754,725 A * 4/1930 Powers
1,930,177 A * 10/1933 Miller et al. ..... 269/245
2,744,334 A * 5/1956 Jondole
3,414,909 A * 12/1968 Provi et al. ..... 269/245
3,419,205 A * 12/1968 Jureit et al.
4,809,614 A * 3/1989 Theurer et al.
4,850,472 A * 7/1989 Liebel et al.
4,930,225 A * 6/1990 Phillips
4,942,822 A * 7/1990 Cotic

FOREIGN PATENT DOCUMENTS

GB 1388414 * 3/1975

* cited by examiner

*Primary Examiner*—Douglas Olms
*Assistant Examiner*—Steve Blount
(74) *Attorney, Agent, or Firm*—Lynn G. Foster

(57) ABSTRACT

Apparatus and methods are disclosed by which wooden railroad ties are pre-plated prior to use in constructing and/or repairing railroad lines. Methodology disclosed comprises placing two plates on top of each of a succession of wooden ties, temporarily positioning disclosed one of the two plates on each tie with a distance or spacer template temporarily clamping the two plates accurately to the tie using a jig, starting a field spike and a gauge spike (usually with one or more sledge hammers) into each wooden tie through the selected apertures in each plate, and further driving the started spikes into the associated tie (usually using a jackhammer). Typically, the field spike is located outside the field flange of the plate and is driven until the head of the spike is contiguous with the plate. Typically, the gauge spike is displaced through an aperture in the gauge flange of the plate until the head is about 1½ inches above the plate.

12 Claims, 7 Drawing Sheets

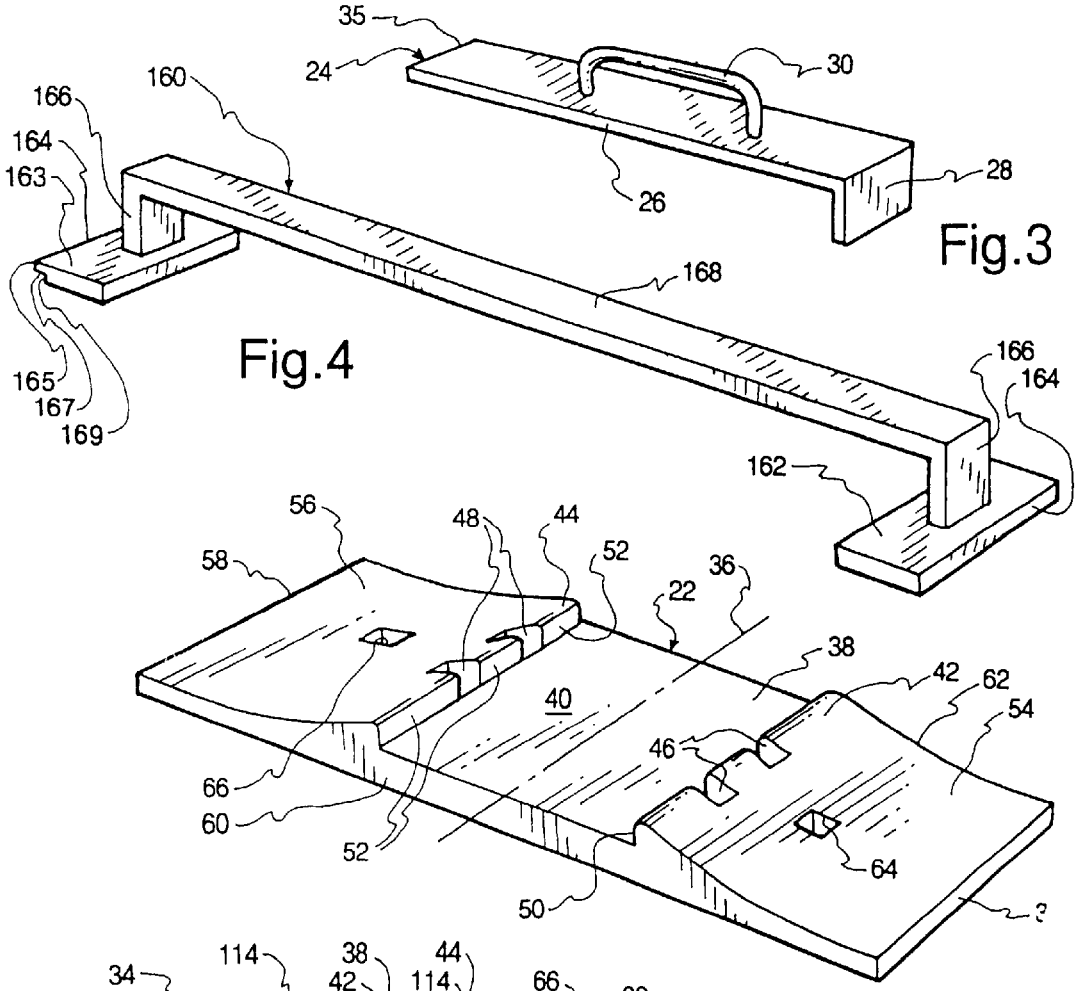
Fig.3
Fig.4
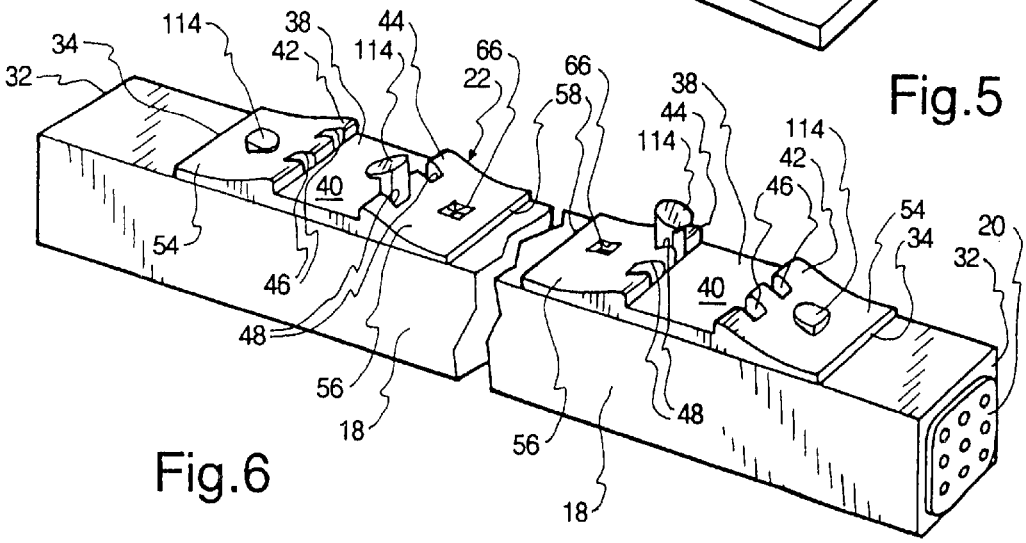
Fig.5
Fig.6

PRE-PLATING OF WOODEN RAILROAD TIES

CONTINUITY

This application is a division of our U.S. patent application Ser. No. 09/322,280 filed May 28, 1999, now U.S. Pat. No. 6,292,997.

FIELD OF THE INVENTION

The present invention relates generally to the use of wooden ties, steel plates and steel spikes in building and/or repairing of railroads and, more particularly, to methods and apparatus for pre-plating wooden railroad ties for subsequent receipt of railroad rails in the initial construction and/or the repair of railroad lines.

BACKGROUND

Railroad lines are comprised of spaced cross ties with superimposed plates, which carry two top spaced rails. The space of the rails determines the gauge of the railroad line. The ties traditionally rest upon ballast, which has been compacted and graded (contoured) to define the path of the railroad line, including axial slope as appropriate and transverse banking to accommodate turning in respect to a change in direction of the rails and ties.

While concrete ties are sometimes used, wooden ties, usually treated with a chemical such as creosote, have historically been used. The present invention is concerned with wooden railroad ties.

Each wooden railroad tie receives two steel railroad plates on the top of the tie. Each plate is secured in position by steel spikes driven into the associated wooden railroad tie through apertures in the plate. Ultimately, at least one field spike and one gauge spike is driven through apertures in the associated plate into the wooden tie until the head of the spike is either contiguous with the top surface of the associated plate or is above the associated plate a distance sufficient to accommodate placement of one side of the lower flange of a rail beneath the head of that spike. This creates a fixed and permanent relationship between the plate and the wooden railroad tie. At the time of rail installation, other spikes are driven through the remaining apertures in each plate. Two apertures exist in each of two central parallel flanges or ridges of each plate and one aperture in each of two plate regions spaced from the flanges. The flanges of each plate are parallel to the direction of the railroad line and perpendicular to the axis of the associated tie. All of the spikes driven through apertures in the flanges of the associated plate into the wooden tie ultimately become contiguous with the top surface of one or the other of two oppositely-directed base, lower or bottom flanges of a railroad rail to hold the rail in a secure position on the plate between the flanges. The rail is thus securely positioned between and parallel to the plate flanges.

In earlier times, it was commonplace to assemble plates, ties, spikes and rails at the site of a railroad line being constructed or repaired. This approach is sometimes still used. Precision in correctly locating each plate on top of the associated tie presented significant problems in the field. Accuracy in field placement of the plates on the ties has been particularly difficult when the plates were worn between the flanges due to prior use.

BRIEF SUMMARY AND OBJECTS OF THE PRESENT INVENTION

In brief summary, the present invention overcomes or substantially alleviates problems associated with the construction and repair of railroad lines and particularly in respect to pre-plating wooden railroad ties. Temporary and permanent placement of two plates (either new or used) on each wooden tie is exceptionally accurate, resulting in few, if any, rejects. Accordingly, subsequent assembly of railroad rails on a series of such pre-plated ties produces corresponding accuracy in the resulting railroad line. Unique jigs provide for the temporary and accurate placement of the plates on the ties, while spikes provide for the permanent and accurate placement of the plates on the ties. Novel methods and apparatus are provided by the present invention for so pre-plating railroad ties. Mass production of pre-plated railroad ties is preferred, although individual pre-plating of railroad ties is within the scope of the present invention. The methodology may comprise placing two plates on top of each of a succession of wooden ties, positioning one of the two plates on each tie with a distance or spacer template, temporarily clamping the two plates accurately to the tie using a jig, starting a field spike and a gauge spike (usually with one or more sledge hammers) into each wooden tie through selected apertures in each plate, and further driving the started spikes into the associated tie (usually using a jackhammer). Typically, the field spike is located outside the field flange of the plate and is driven until the head of the spike is contiguous with the plate. Typically, the gauge spike is displaced through an aperture in the gauge flange of the plate until the head thereof is about 1½ inches above the plate. This gauge spike ultimately is driven downward farther to help hold a rail in position when the rail is superimposed upon the plate between the flanges thereof.

A series of work stations may be employed in carrying out the pre-plating assembly process. One or more of the work stations may use conveyor systems to displace ties as they are pre-plated and to return removed jigs for re-use. Normally, although not necessarily, the spikes are started with one or more sledge hammers, while the driving of spikes is preferable by use of a power tool, such as a jack hammer.

When the pre-plating of the ties is completed, they may be stored for subsequent use or shipped for more immediate use.

For purposes of efficiency and cost effectiveness, a mass production or continuous process of pre-plating ties sequentially is preferred, which requires inventories of ties, plates, spikes and jigs, all made available at an ingress work location. The jigs are recycled, while the ties, plates and spike are transformed into completed pre-plated ties. Testing templates or spacers may be used to initially locate the plates on the ties before spikes are started and to check the permanent locations of the plates of completed pre-plated ties for accuracy or compliance with applicable tolerances. The preferred reference is to the inside surface of the field flange of each plate. One jig is used to so locate both plates in respect to a given wooden railroad tie.

The preferred jig, for accurately locating plates on railroad ties being pre-plated, comprises a frame which seats around side surfaces of a railroad tie, at least one plate position-establishing cross bar or stop extending between frame members for contiguous engagement with an inside surface of a flange of a railroad plate placed on top of the tie, and at least one displaceable clamping member for engagement with an adjacent edge of plate to compressively place the plate in a desired fixed position upon the tie prior to an aperture in the plate receiving a railroad spike. At least one clamping member may be actuated in any desired way, e.g., using a hydraulic or pneumatic cylinder or a mechanical crank of the jig, to engage the field edge of the adjacent plate, for example, insuring that a cross bar or stop of the jig bears against the inside surface of the adjacent field flange of the plate.

With the foregoing in mind, it is a primary object of the present invention to overcome or substantially alleviate problems associated with the construction and/or repair of railroad lines and particularly in respect to pre-plating wooden railroad ties.

Another important object is the temporary and permanent placement of the plates (either new or used) on a wooden tie with exceptional accuracy, resulting in few, if any, rejects, and producing corresponding accuracy within the resulting railroad lines.

A further valuable object is the provision of unique jigs which provide for the temporary and accurate placement of plates on the wooden railroad ties, while spikes, used in conjunction with each jig, provide for the permanent and accurate placement of the plates on the ties.

It is another dominant object of the present invention to provide novel methods and apparatus for pre-plating wooden railroad ties.

It is an additional significant object to provide mass production methods and apparatus for pre-plated wooden railroad ties.

Another valuable object is the provision of methodology which comprises placing two plates on top of each of a succession of wooden railroad ties, temporarily positioning of each of the two plates accurately on each tie using a jig, starting a field spike and a gauge spike into each wooden tie through selected apertures in each plate, and further driving the started spikes into the associated tie.

A further important object is the provision for locating a field spike outside the field flange of an associated plate and driving it until the head of the spike is contiguous with the plate and locating a gauge spike through an aperture into the gauge flange of the plate and driving it until the head thereof is a predetermined distance above the plate so that the gauges spike can ultimately be driven downward farther to help hold a rail in position when the rail is superimposed upon the plate between the flanges thereof.

A further primary object is the provision of a series of work stations for carrying out a pre-plating assembly process for wooden railroad ties.

It is another significant object of the present invention to provide one or more work stations which may use conveyors to displace wooden railroad ties as they are pre-plated and to return removed jigs for re-use.

Another object of value is the provision of mass production or continuous processes of pre-plating wooden railroad ties sequentially, which require inventories of ties, plates, spikes and jigs all made available at an ingress work location.

It is a further object of significance to provide pre-plating jigs for wooden railroad ties which are reusable.

It is a further object of dominance to provide testing templates or spacers used to initially locate the plates on wooden railroad ties before spikes are started and to check the permanent locations of the plates of completed pre-plated wooden railroad ties for accuracy or compliance with applicable tolerances.

An additional object of importance is the provision of pre-plating jigs for accurately locating plates on wooden railroad ties being pre-plated.

It is another valuable object to provide a pre-plating jig for a wooden railroad tie which comprises a frame which seats around side surfaces of a wooden railroad tie, at least one plate position-establishing cross bar or stop extending between frame members for contiguous engagement with an inside surface of a flange of a railroad plate placed on top of the tie, and at least one displaceable clamping member for engagement with an adjacent edge of the plate to compressively place the plate in a desired fixed position upon the tie prior to an aperture in the plate receiving a railroad spike.

It is another object of importance to provide a pre-plating jig for a wooden railroad tie comprising at least one clamping member which is actuated in any desired way, e.g., using a hydraulic or pneumatic cylinder or a mechanical crank of the jig, to engage the field edge of the adjacent plate causing a cross bar or stop of the jig to bear against the inside surface of the adjacent field flange of the adjacent plate.

These and other objects and features of the present invention will be apparent from the detailed description taken with reference to the accompanying drawings.

BRIEF DESCRIPTION OF THE DRAWINGS

FIG. 2B' is a fragmentary perspective of a conveyorless central work station which started spikes are farther driven into an associated wooden railroad tie through apertures in the two railroad plates to pre-plate the tie;

FIG. 3 is an enlarged perspective of a hand tool or distance template or spacer with which a plate loosely on a tie is preliminarily located for later receipt of a clamping jig and spikes;

FIG. 4 is an enlarged perspective of a tolerance gauge tool or template or spacer, comprising a stepped foot, with which the location of the spike-secured plates are checked for railroad gauge accuracy;

FIG. 5 is an enlarged perspective of a typical steel railroad plate;

FIG. 6 is an enlarged perspective, with a portion broken away for ease of presentation, of a completed pre-plated wooden railroad tie;

DETAILED DESCRIPTION OF THE ILLUSTRATED EMBODIMENTS

Figure 1:
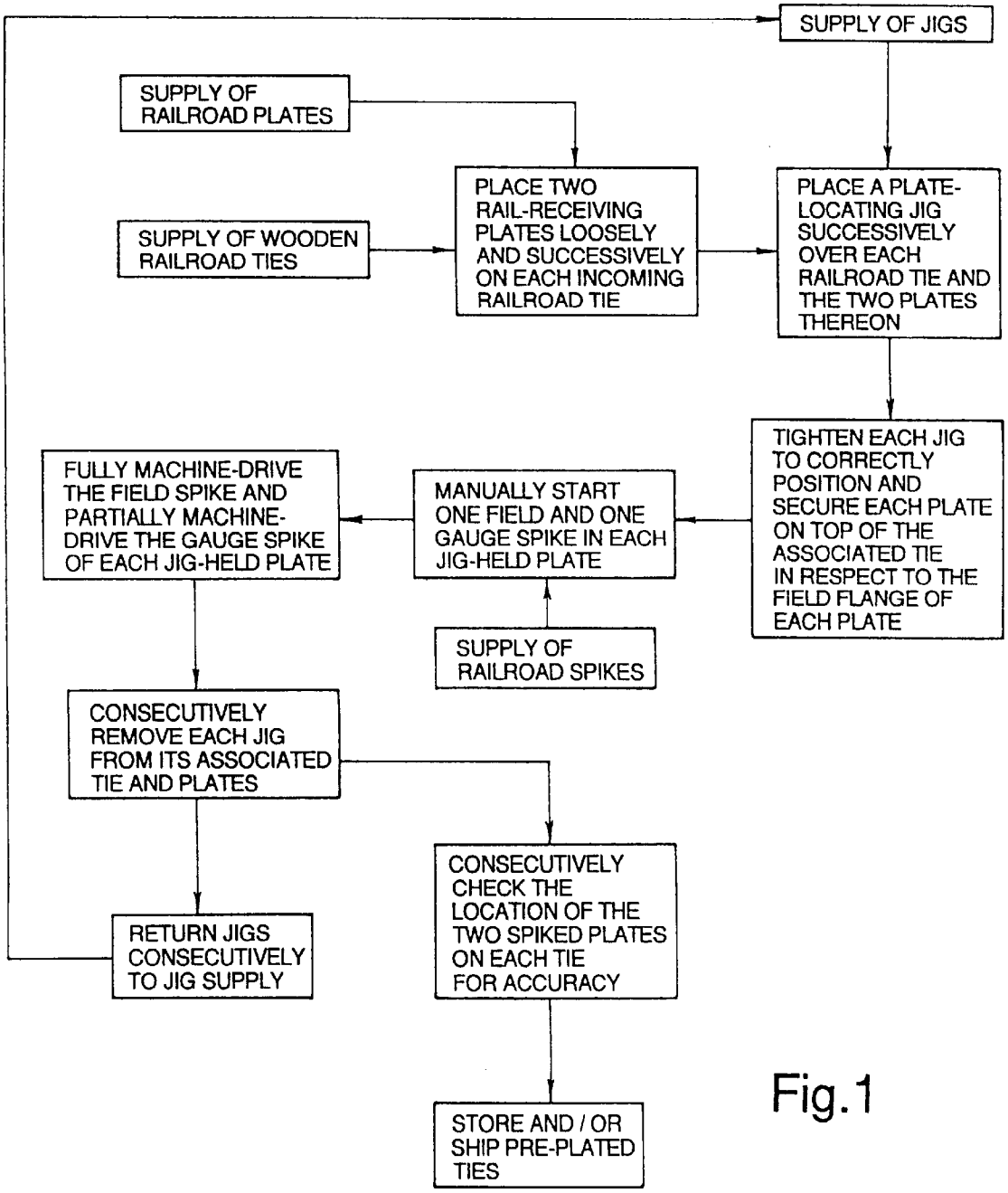
FIG. 1 is a flow chart is a flow chart of methodology according to the present invention by which wooden railroad ties are pre-plated.

Reference is now specifically made to the drawings wherein like numerals are used to designate like parts throughout. FIG. 1 is in flow chart form and illustrates one form of methodology which embodies principles in accordance with the present invention by which wooden railroad ties are pre-plated in advance of use in initially constructing or repairing a railroad line. In respect to FIG. 1, inventories of wooden railroad ties, steel railroad plates, steel railroad spikes and custom jigs are provided. The ties, plates and spikes may be new or used. Sometimes reconditioned or reclaimed wooden railroad ties are pre-plated. Whether new or used, the railroad ties are positioned so that each one being processed receives on the top thereof, in loose condition, two rail-receiving plates. The preliminary location of one of the two plates in respect to the associated tie may be established using a distance-establishing tool or template or spacer. With the two rail-receiving plates positioned generally correctly on top of the associated railroad tie, a jig is superimposed over the top of the tire at the perimeter thereof, namely along the sides adjacent to the top of the jig such that a position-locating stop or cross bar passes through a channel or rail seat surface of each plate between parallel flanges of the plate.

It is preferred that the methodology depicted in FIG. 1 be one which comprises mass production techniques so that a series or succession of ties are processed one after another in continuing manner.

Once the jig is correctly placed as if a crown upon the railroad tie, a clamping member at each end of the jig is actuated to clamp against the field edge of the adjacent plate so that the bar or stop forcibly and contiguously engages the inside surface of the field flange of the plate. As a consequence, the two plates are rigidly, though temporarily, held in precisely the desired position on top of the associated railroad tie. Thus, the distance from the inside surface the field flange of one plate to the inside surface of the field flange of the other plate is precisely set to accurately later receive two rails having exactly the correct railroad gauge needed.

At this point, a field spike and a gauge spike are started into the wooden railroad tie through appropriate apertures in each jig-held plate. Specifically, a gauge spike is driven into the wooden railroad tie through an aperture in the field side of each plate which is located remote from the field flange. The gauge spike is driven into the wooden railroad tie through an aperture in the gauge flange of each plate. In both cases, each spike is merely started into the wooden railroad tie. This may be done by manual manipulation of one or more sledge hammers or otherwise as appropriate.

The field spike mentioned above is, thereafter, machine-driven fully into the wooden railroad tie until the head of the field spike is contiguous with the top surface of the associated plate. Preferably a jack hammer or like automated tool is used to so drive the field spike. The gauge spike is likewise machine-driven until the head thereof is on the order of 1½ inches above the gauge flange. The gauge spike is left in this position, with the eccentric portion of the head of the spike directed toward the field flange of the same plate to accommodate later receipt of one side of the bottom flange of a railroad rail when the pre-plated tie is used to construct or repair a railroad line.

Ordinarily, the described pre-plating of railroad ties occurs at a factory or similar location remote from the location where the ties are used to construct or repair a railroad line, although a pre-plating plant could be located near the site where the railroad line is being constructed or repaired and could be portable so as to keep pace with the construction or repair of the railroad line.

Once the one field spike and the one gauge spike are driven in the manner indicated above, the clamping mechanisms of the jig are released and the jig is entirely removed from the tie and the plates. The jig is returned to the ingress area of the pre-plating plant for reuse, while the completed pre-plated tie is checked with a tolerance tool or template or spacer to ensure that the two spiked plates are positioned within the necessary tolerances required for accuracy. The pre-plated ties are removed from an egress station, using a forklift, for example, and either stored or shipped for use in constructing or repairing a railroad line or both.

Figures 2, 2A, 2B, 2C:
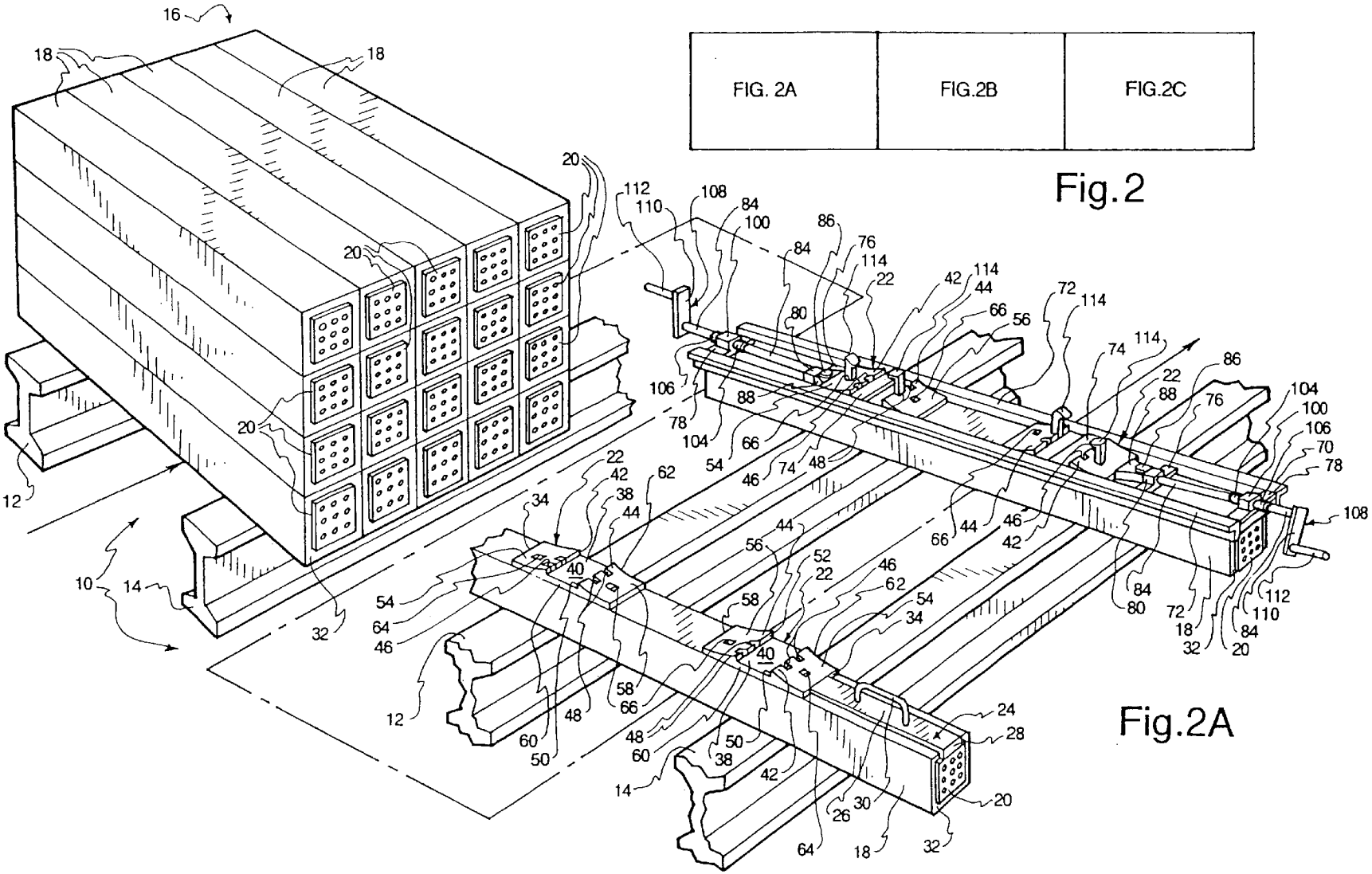
FIG. 2 is a block diagram showing the way in which FIGS. 2A, 2B and 2C interrelate one with another.
FIG. 2A is a fragmentary perspective of an ingress work station or site where wooden railroad ties, steel railroad plates, steel railroad spikes and steel plate-locating jigs are brought together and assembled up to the point where two spikes are started into a wooden tie through apertures in two plates temporarily held in correct positions on top of the tie by the jig comprising opposed crank clamping mechanisms.
FIG. 2B is a fragmentary perspective of a central work station to further drive the spikes into the associated wooden tie and through which ties from the ingress work station are successively displaced to a jig removal station by a first conveyor system, whereby the removed jigs are returned to the ingress station and the completed pre-plated ties are placed at a discharge station for shipment and/or storage.
FIG. 2C is a fragmentary perspective of the downstream end of the central work station of FIG. 2B and the accumulation discharge station or site for shipment and/or storage.
Figure 2B:
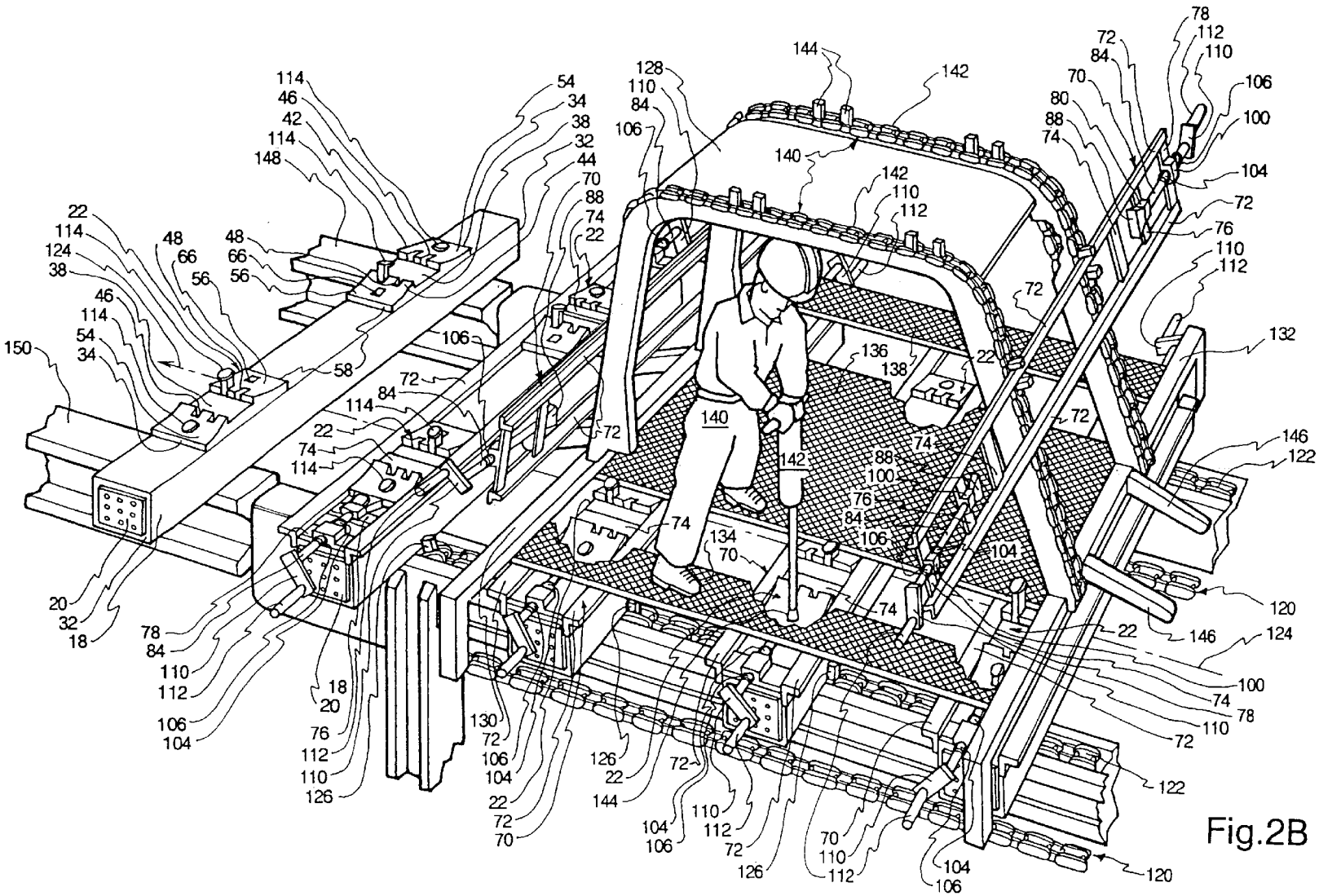
Figure 2B:
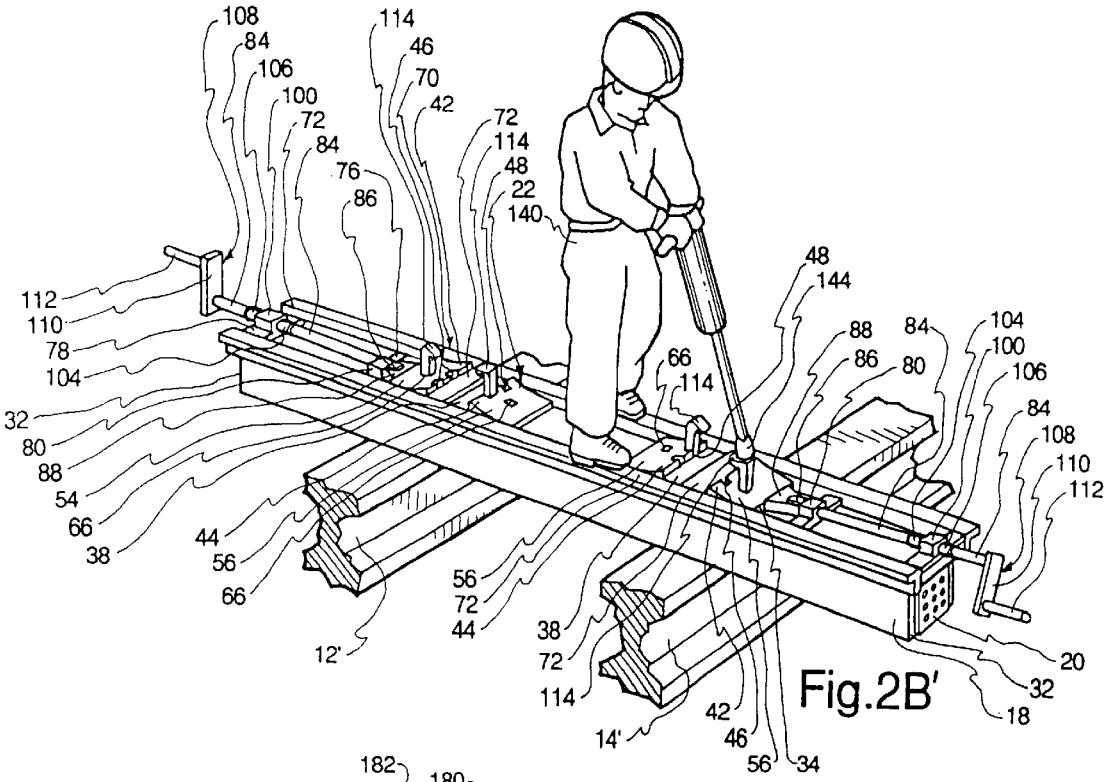

Reference is now made to FIG. 2 which illustrates the manner in which the work stations depicted in FIGS. 2A, 2B, and 2C interrelate. It is to be appreciated that the orientation depicted in FIG. 2B is essentially the reverse of and distinct from the orientation depicted in FIGS. 2A and 2C. In respect to FIG. 2A, an ingress or entry work station, generally designated 10, is depicted. The ingress work station or site 10 is illustrated as comprising spaced structured I-beams 12 and 14, which may be supported on the ground, on a floor or above the ground or floor on columns (not shown), for example. The I-beams could be replaced by a platform if desired. Typically, a supply or stack of ties, generally designated as 16 and comprising individual ties 18, is transported to the work station 10 and deposited across the spaced, parallel I-beams 12 and 14. A forklift, for example, may be used to place the ties 18 in the position illustrated in FIG. 2A. The stack 16 of ties 18 may be held together by one or more steel bands (not shown), which are cut before or after placement at the ingress station 10, as illustrated in FIG. 2A. Each tie 18 is illustrated as having a metal cleat 20 secured on each end, to prevent damage. It is to be appreciated that not all ties used to form railroad lines have end cleats. It is further to be appreciated that different ties have different dimensions. For example, some ties are approximately nine feet long, while others are shorter.

The ties 18 are removed one-by-one from the stack 16 and are placed sequentially across the rails 12 and 14, one after another. With continued reference to FIG. 2A, two individual ties 18 are illustrated in spaced relation at the right portion of FIG. 2A. The first separate tie 18 shows two steel railroad plates, generally designated 22, placed loosely on top of the tie. The unattached placement of right plate, to begin with, may be ascertained by use of a hand tool or spacer, generally designated 24. As shown in FIGS. 2A and 3, placement tool 24 has an L-shaped configuration comprising a long leg 26 and a short leg 28. The tool 24 is preferably formed from steel, although other suitable materials may be used. The tool 24 is manipulated by a U-shaped handle 30, which may be welded to the L-shaped portion. The legs 26 and 24, being respectively planar and disposed at 90 degrees one to the other, accommodate placement of the leg 28 contiguous with one end edge 32 of the tie, with the leg 26 running contiguously along the top surface of the tie. See FIG. 2A. By placing the field edge 34 of one plate 22 against the free edge 35 of the tool 24, the one plate is loosely positioned approximately where it will need to be when the pre-plating operation has been completed. The second plate 22 is thereafter correctly positioned on the tie 18 using a jig 70, as explained hereinafter.

Not all steel railroad plates are dimensionally the same. There are variations in size. The steel railroad plates 22, which are illustrated in the drawings and described herein, are intended to be representative and not restrictive. As best shown in FIG. 5, each illustrated plate 22 comprises a field side and a gauge side, the gauge side being juxtaposed one end of the associated tie 18 and the gauge side being juxtaposed the central portion of the associated tie 18. The plate 22 is essentially symmetrical about a central line 36, except for a rail seat surface 40. The plate 22 comprises a rail-receiving channel 38, comprising top surface 40 which is slightly sloped toward the gauge side of the plate 22. Surface 40 spans between a field flange or ridge 42 and a gauge flange or ridge 44. In use, two plates 22 are held by steel railroad spikes at space locations on top of a railroad tie 18 with the channel 38 extending perpendicular to the axis of the tie. Two railroad rails are positioned respectively in the channels 38 on the sloped surfaces 40 of the two spaced plates 22, the rails ultimately being secured to the plates against inadvertent displacement by steel railroad spikes passing through two apertures 46 in the field flange 42 and two apertures 48 in the gauge flange 44, as more fully described hereinafter. The oppositely sloped surfaces 40 on the two plates 22 cause the two rails to slightly toe in toward each other for better performance.

It follows that each field flange 42 defines a channel or interior linear surface 50, while the gauge flange 44 defines a similar interior surface 52. The field flange 42 tapers into a field region 54, which terminates in field edge 34. Similarly, each gauge flange 44 tapers outwardly across a gauge region 56, which terminates in edge 58. Each plate 22 also comprises a trailing edge 60 and a leading edge 62 which are both oriented essentially parallel to the direction of the tie and perpendicular to surfaces 50, 52, 58 and 34. The field region 54 has an aperture 64 for receiving a steel railroad spike during pre-plating at a location remote or spaced from the field flange 42. Similarly, the gauge region 56 defines a rectangular aperture 66 for receiving a steel railroad spike during rail installation at a location remote from the gauge flange 44. The spikes which are ultimately driven through apertures 64 and 66 into the associated wooden railroad tie are so displaced until the heads of the spikes are contiguous with the top surface of the associated plate 22, for the purpose of anchoring the plate 22 to the wooden railroad tie in a precise location. Spikes placed through apertures 64 and 66 may be number one grade or less, while spikes placed in apertures 46 and 48 need to be number one grade.

It is to be understood that the present invention applies to utilization of both new and used or recycled steel railroad plates in the pre-plating of wooden railroad ties. After the two plates 22 have been placed loosely on top of one of the ties 18, as shown in the lower portion of FIG. 2A, the next step in the pre-plating process herein disclosed is to temporarily or releasibly secure each of the two plates in a fixed position in respect to the tie so that relative movement between either plate 22 and the tie 18 is prevented and so that the plates are precisely positioned on the top of the tie to meet tolerance requirements and to avoid rejection of pre-plated ties for being out of tolerance.

A jig, generally designated 70, is used to hold both plates rigidly in the desired positions. See FIGS. 2A, 8 and 9. As best seen in FIG. 2A, the jig 70 is superimposed over both the top of the associated tie 18 and over the two plates 22. More specifically, each side surface of the associated railroad tie 18 is contiguously engaged by one, vertically-directed leg of parallel, spaced structural angle members 72 of the jig. The jig 70, with the clamping mechanisms retracted, is placed in an angular orientation to the associated tie 18 with the jig end down which is adjacent to the right plate (as viewed in FIG. 2A). The right cross bar 74 of the jig 70 is next placed in the channel 38 of the right plate 22, as the left end of the jig 70 is rotated downwardly with the vertical legs of the angle members 72 contiguous with the opposed sides of the tie 18. The jig rotation is continued until the left cross bar 74 is in the channel 38 of the left plate 22 and the spaced angle members 72 are horizontally disposed and the vertical legs of members 72 are respectively contiguous with the side surfaces of the tie 18 near the top of the tie.

Six cross bars are provided comprising interior parallel cross bars 74, intermediate parallel cross bars 76 and parallel and/or outside cross bars 78. Each of the six cross bars 74, 76 and 78 are welded at their respective ends to the vertical leg of both angle members 72, to form a rigid frame. While cross bars 78 are illustrated as being arranged to extend across the top surface of the associated tie 18, if desired, they can be arranged so as to engage tie end surfaces 32. Cross bars 78 are in a plane slightly above a plane containing cross bars 76, while cross bars 74 are in a third plane disposed somewhat above and parallel to the plane containing cross bars 78. See FIG. 8. The distance between the two planes containing cross bars 76 and cross bars 74 is essentially the thickness of plate 22 at channel 38. This accommodates placement of the cross bars 74 through the channels 38 of the spaced plates 22 on top of tie 18, as best depicted in FIG. 2A.

By locating the cross bars 78 above the cross bars 76, clamping members of the jigs are slightly sloped to insure firm engagement by the clamping mechanism of the plate edge 34. The cross bars 74, 76 and 78 are essentially the same length so that the jig 70 is a rectangle. The length of each cross bar 74, 76 and 78 is also essentially equal to the width of the railroad tie 18. Since the dimensions of railroad ties can vary, not only in terms of the height and width but also in terms of the length, jigs for any particularly sized tie are custom manufactured. For larger or smaller railroad ties, jigs of the type illustrated in the drawings are fabricated to match the dimensions of the tie with which they are intended to be used.

Figure 8:
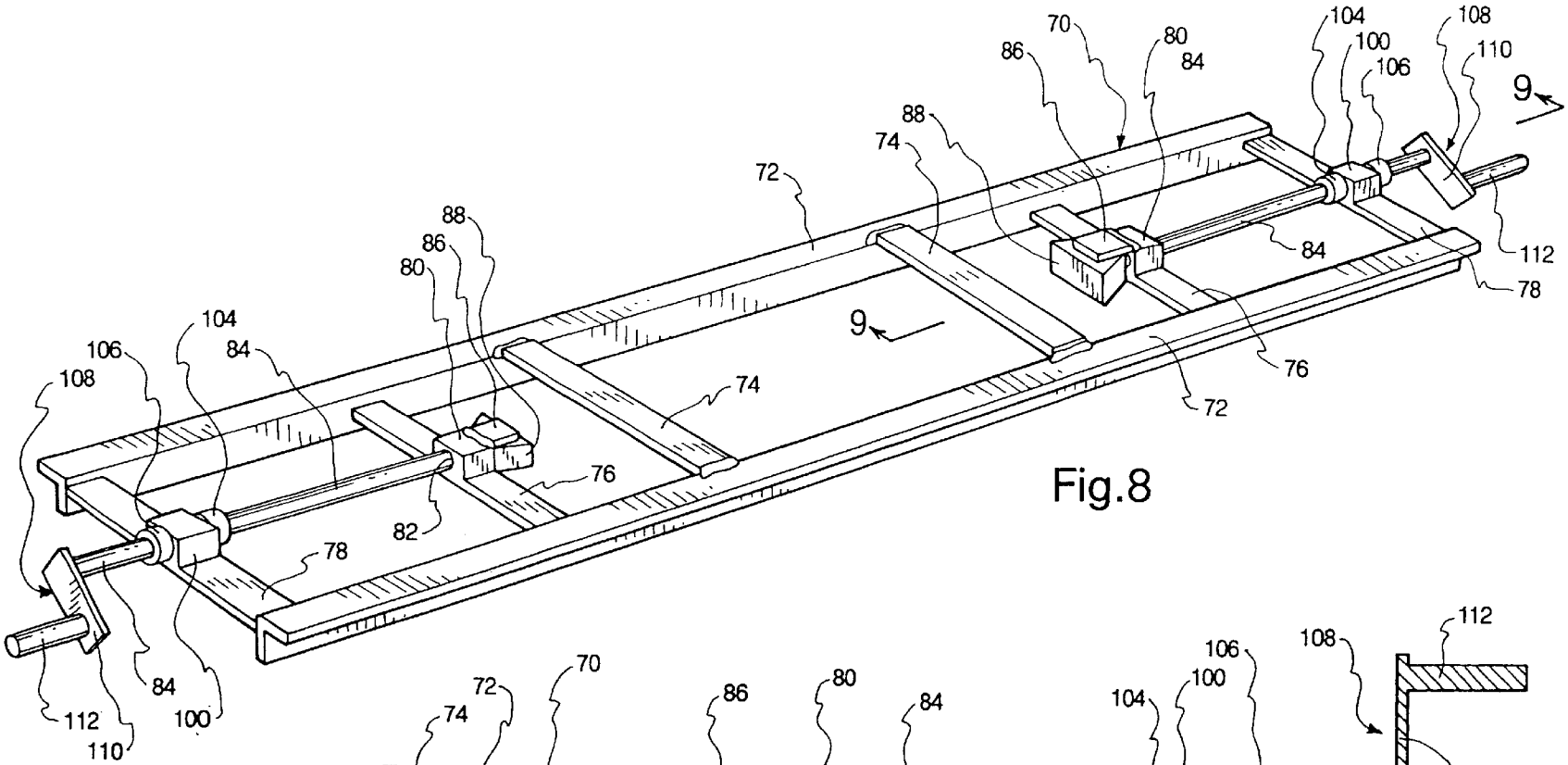
FIG. 8 is a perspective of a jig embodying principles of the present invention comprising two end clamps each comprised of a plate flange-engaging cross bar or stop and a crank mechanism with a displaceable clamping head or moveable stop.
Figure 9:
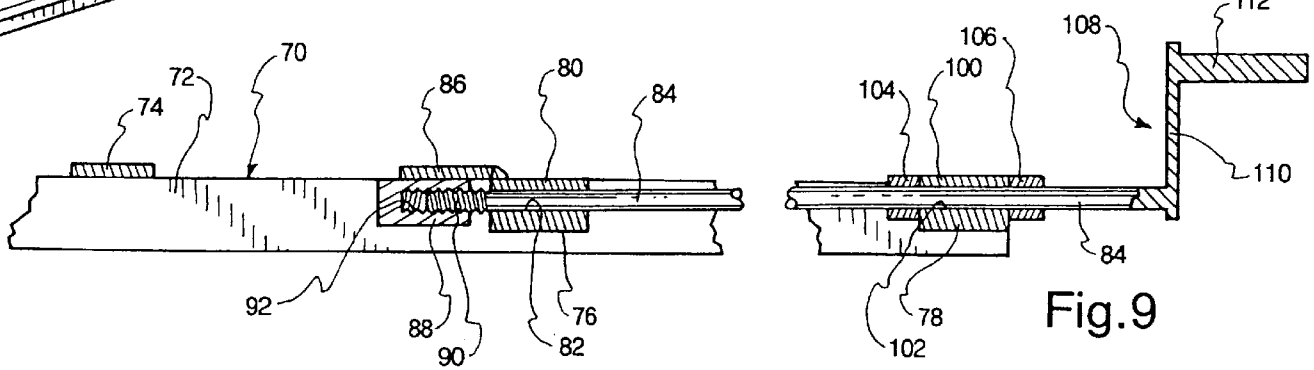
FIG. 9 is a cross section taken along line 9—9 of FIG. 8.

Centrally located on each cross bar 76 is a journal block 80. Each journal block 80 is anchored, as by welding, to its associated cross bar 76 and provides a throughbore 82, which is centrally disposed and oriented transverse to the associated bar 76. A distal portion of a shaft 84, which is smooth, extends through the associated bore 82 for rotation in respect to the bore 82. Each journal block 80 is welded to a canopy-type plate 86 which eccentrically extends toward the center of the jig 70 beyond the limits of the block 80, as best shown in FIGS. 8 and 9. A clamping end or moveable stop or plate engagement head 88 is disposed immediately below extension plate 86, plate 86 serving as an anti-rotate member preventing the wedge-shaped clamping head or movable stop 88 from rotating.

Each shaft 84 comprises a threaded distal end 90 (FIG. 9). Thus, the rounded portion of shaft 84, which journals in block 80 accommodates rotation of the shaft 84 in respect to the journal block 80, while the threads 90 of the distal end of the shaft 84 are threaded into or out of a blind threaded bore 92 in head 88, depending on the direction of rotation. Because the shaft 84 is limited to rotation without axial displacement (as explained hereinafter in greater detail) and because anti-rotation plate 86 prohibits rotation of clamping head 88, rotation of shaft 84 causes the clamping block 88 to move left or right as viewed in FIG. 9 in relationship to the shaft 84, depending upon the direction in which the shaft 84 is rotated. Thus, the movable clamping stop or wedge-shaped head 88 may be advanced toward the adjacent plate 22 or retracted from the adjacent plate 22, for reasons explained in greater detail later. Each cross bar 78 supports in superposition a journal block 100, which may be welded centrally to the associated cross bar 78 so that a journaling throughbore 102 of block 100 is located parallel to the journal bore 82 of the journal block 80. The size of the shaft 84 and that of the throughbore 102 are such that a snug fit is achieved which accommodates selective rotation of the shaft 84 in respect to the stationary journal block 100. Spaced steel sleeves 104 and 106 are welded to the shaft 84 adjacent the opposed sides of the journal block 100 so as to accommodate rotation of the shaft 84 within the journal blocks 80 and 100, with the sleeves 104 and 106 preventing axial displacement of the shaft 84 relative to the journal blocks 80 and 100. See FIG. 9.

Each shaft 84 is joined at its proximal end to a crank arm mechanism 108 by which rotation of the shaft 84 is accomplished. As shown best in FIGS. 8 and 9, the crank arm mechanism 108 comprises a stepped bar 110, welded to the distal end of the shaft 84 and an eccentric grasping handle 112, welded to the eccentric end of the plate 110. Thus, by grasping the handle 112 and causing it to rotate either clockwise or counterclockwise, as desired, the shaft 84 rotates within journal blocks 80 and 100, with the threads of movable stop 88 inter-reacting with the threads 90 at the distal end of the shaft 84 so that the wedge-shaped movable clamping member 88 is advanced or retracted in respect to the adjacent cross piece 74.

This motion is important to clamp each of the two plates temporarily but fixedly in respect to the top of the associated tie 18. This is done by rotating each crank mechanism 108 in the appropriate direction so as to move clamping heads 88 toward the adjacent plate 22. When the field edge 34 of the adjacent plate 22 is engaged, cranking is continued until such time as the adjacent cross bar or stop 74 is forcibly contiguous with the inside surface 50 of the field flange 42 of the associated plate 22. The clamping head 88 is similarly firmly contiguous with the edge 34. Thus, when both clamps of jig 70 have been so activated, both associated plates 22 are temporarily though firmly held in a tolerance-accommodating position. When this position has been achieved, two or more spikes 114 are started, using one or more sledge hammers, into the associated wooden railroad tie 18 through selected apertures in the two plates 22. While the aperture selection could vary, the selection illustrated in FIGS. 2A, 2B, 2C and 2B' works well. More specifically, one steel railroad spike is illustrated as having been started through plate aperture 64, which is disposed in the plate region 54 of the associated plate and a second spike is placed in one of the two spike-receiving apertures 48 disposed in the gauge flange 44. Since the standard railroad spike has an eccentrically-disposed head, the head of the spike 114 in the aperture 64 of each plate is oriented toward the center of the tie 18, while the head of the spike 114 placed in aperture 48 of each plate 22 is oppositely oriented, i.e. outwardly toward the adjacent crank handle 108. The assembled nature of the spikes 114, the plates 22, the jig 70 and the associated tie 18 is illustrated in FIG. 2A, at the upper right location.

While FIG. 2A comprises a work station where movement of the ties is manual, it is to be understood that the ties 18 may be placed upon a conveyor system for automatically moving the ties through the work station illustrated in FIG. 2A.

Each partially pre-plated tie emanating from the work station of FIG. 2A is displaced to a second work station, one form of which is illustrated in FIG. 2B and another in FIG. 2B'. In reference to FIG. 2B, the orientation of that work station, as shown, is essentially the reverse of the orientation of FIG. 2A, for clarity of illustration. Each partially pre-plated tie 18 emanating from the work station of FIG. 2A is displaced through the work station of FIG. 2B via a conveyor system. The tie conveyor system of FIG. 2B is generally designated 120 and comprises two parallel chain link conveyors 122, each of which is conventional and, accordingly, an extensive disclosure thereof is not essential to an understanding of the present invention by those skilled in the art. The ties 18 processed through the work station of FIG. 2B move in the direction of the arrows 124, i.e., from right to left. The parallel conveyors 120 each comprises spaced abutment studs 126, two of which (one from each conveyor 122) engage and push on the back side of each tie 18 delivered from the work station of FIG. 2A. The conveyors 122 preferably are variable speed conveyors so that the rate at which partially pre-plated ties 18 from work station 2A are displaced through the work station of 2B may be controlled to ensure both efficiency and accuracy.

The work station of FIG. 2B comprises a canopy 128, cross supports 130 and 132 and three floor segments or catwalks 134, 136 and 138 comprised of conventional steel grating. The canopy 128, the cross supports 130 and 132 and the grating platforms 134, 136 and 138 are suitably supported by conventional structural members in the air above both the conveyors 122 and the partially pre-plated ties 18 so as to accommodate displacement of the ties beneath the canopy 128, the cross supports 130 and 132 and the grating platforms 134, 136 and 138, as shown in FIG. 2B. A worker 140 is illustrated in FIG. 2B as standing upon grating platforms 134 and 136 while holding a spike-driving tool 144, which may be a jackhammer with an appropriate tip or driving head 144. Other suitable automated driving tools, such as pneumatic and hydraulic cylinder assemblies, may also be used. The jackhammer may be electric, pneumatic or hydraulic and is used to drive the spikes 114 disposed in each aperture 64 fully into the associated wooden railroad tie so that the head thereof is contiguous with the plate region 54. The jackhammer 142 is also used to drive the spike 114 disposed in one of the apertures 48 until the head thereof is on the order of an inch and a half or so above the plate flange 44. This provides a suitable space for later placement of a railroad rail in the channel 38 so that one side of the bottom flange is spaced directly below the head of the spike 114 disposed in one of the two apertures 48. It should be apparent that the last mentioned spike 114 will later be driven further so as to become contiguous with the adjacent bottom flange of the rail during field installation of the rail. At that time, spikes would also be suitably driven through the remaining apertures in each plate 22 whereby the spikes in apertures 64 and 66 hold the plate in position on the tie and the spikes in the four apertures 46 and 48 engage the rail at opposed bottom flanges to secure the rail to the plate 22.

As a consequence, when the pre-plated ties 18 emerge at the back side of the canopy 128 on conveyors 122, the plates 22 are illustrated as being secured by the two spikes 114 against displacement relative to the associated tie 18. Accordingly, the jig 70 associated with the tie 18 may be removed by turning the two crank handles so as to loosen the two clamping heads 88 from engagement with the edge 34 of the adjacent plate 22. At this point, the jig is lifted from the associated tie and is returned to the work station of FIG. 2A to be reused.

Preferably, the work station of FIG. 2B comprises a second conveyor system, generally designated 140, which comprises two spaced conventional chain conveyors 142. The conveyors 142 comprise outwardly directed studs 144 upon which the removed jigs 70 are hung and conveyed from left to right, as viewed in FIG. 2B, to a location directly adjacent the work station of FIG. 2A. The jigs 70 being so conveyed engage two sloped ramp members 146 adjacent to the FIG. 2A work station, which removes each jig 70 from the conveyors 142, following which the jigs 70 are manually reused, in the manner described earlier in conjunction with FIG. 2A.

When the jig 18 has been removed from a completed pre-plated tie 18, the tie 18 has the appearance as shown at the extreme left in FIG. 2B. It is shown as resting upon two spaced I-beams 148 and 150, which may in turn be supported on columns or the like (not shown).

One of the advantages of the work station of FIG. 2B is that the worker 140 stands on platforms separated from and located above the partially pre-plated ties 18 so that worker damage to the jigs 70 is either entirely eliminated or substantially so.

In lieu of the conveyor-mechanized work station of FIG. 2B, the stationary work station of FIG. 2B' may be used. While the work station of FIG. 2B' is illustrated as being supported upon two I-beams 12' and 14', almost any type of stationary platform configuration would be suitable for providing support for partially pre-plated ties 18 coming sequentially from the work station of FIG. 2A. The partially pre-plated tie 18, with plates 22, started spikes 114 and jig 70 of the type illustrated in the upper right hand portion of FIG. 2A, is also illustrated in FIG. 2B' and has been correspondingly numbered. No further description is necessary, except to say that the worker 140 with jackhammer 142 equipped with socket 144 will stand at least some of the time on the jig 70 in the course of driving the spikes 114, in the manner heretofore indicated. Where the worker 140 does stand and walk upon jigs 70, it may be necessary for the jigs to comprise components which are structurally larger and stronger than those used at the work station of FIG. 2B.

Reference is now made to FIG. 2C, which illustrates, in the upper right hand portion, the downstream end of the work station of FIG. 2B. The pre-plated tie 18 shown at the left in FIG. 2B is reproduced on the right in FIG. 2C. It is to be understood that the pre-plated tie 18 illustrated in FIG. 2C may arrive from either the spike-driving work station of FIG. 2B or the spike-driving work station of FIG. 2B'.

The pre-plated tie 18 illustrated at the right in FIG. 2C includes a U-shaped distance-measuring tool or template or spacer, generally designated 160. This distance-measuring tool is illustrated in enlarged perspective in FIG. 4 and comprises opposed plate-like pedestals or feet 162 and 163. The foot 162 comprises an outside edge surface 164 adapted to engage the inside surface 50 of the field flange 42 of the right plate 22 on top of the pre-plated tie 18. The left foot 163 comprises an outside edge surface 165 and a bottom notch comprising horizontal surface 167 and vertical surface 169. The distance of surface 167 from surface 165 to surface 169 equals the permitted tolerance for plate placement. For example, this may be ⅛" or 1/16" or otherwise, depending on the specified tolerance. With the right pedestal or foot 162 engaging right plate surface 50 at edge 164, the plates 22 are within tolerance if the edge 169 is within the channel 38 of the left plate 22 and edge 167 is not within this channel 38. The tool 160 is preferably formed of steel, although other materials could be used, and comprises opposed short columns 166 of equal length and a connecting beam 168. Beam 168 may appropriately be welded to columns 166, which in turn may be welded to plates 162 and 163.

Since each completed pre-plated tie 18 is manually tested with the tool 160, it is immediately known whether each tie is within tolerances. Those few which are not, if any, are corrected. However, all or nearly all completed pre-plated ties 18 are found to be within the require accuracy tolerances and, therefore, there are few, if any, rejects.

With continued reference to FIG. 2C, the completed pre-plated ties 18 which have been checked for plate location tolerance are next displaced down parallel ramps 170, until a suitable number have been accumulated, at which time, a forklift or other suitable mechanized lifting apparatus is used to simultaneously hoist several of the completed pre-plated ties 18 for placement in storage or upon or in a suitable vehicle for transportation to another storage site and/or to an installation site where a railroad line is being constructed or repaired. The sloped ramps 170 are illustrated as being connected, as by welding, to a transverse abutment 172, from which two upwardly-directed triangularly-shaped stops 174 project. Stops 174 are engaged by the initial completed pre-plated tie 18 moving down ramps 170 to establish the aligned grouping of completed ties shown toward the left in FIG. 2C. It is to be appreciated that ramps 170 may comprise roller conveyors or any other suitable structure for satisfactorily processing completed pre-plated ties 18 from the work station of FIG. 2C to another location.

Figure 7:
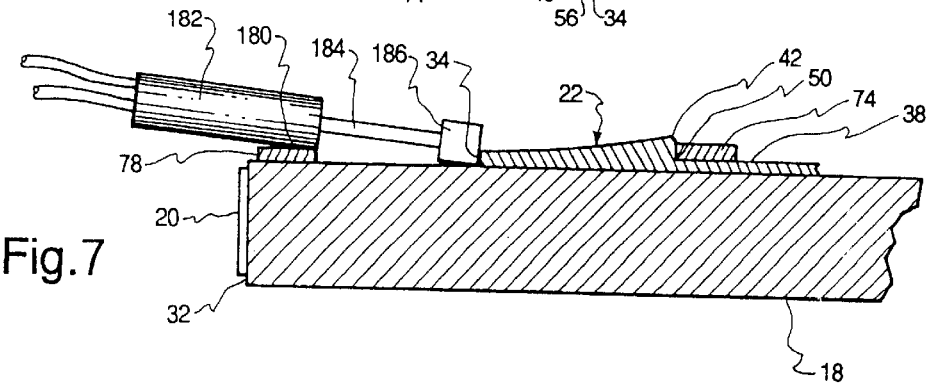
FIG. 7 is a cross sectional view of a jig comprised of a hydraulic or pneumatic cylinder used to temporarily clamp a railroad plate in a correct position on a wooden railroad tie.
Figure 2C:
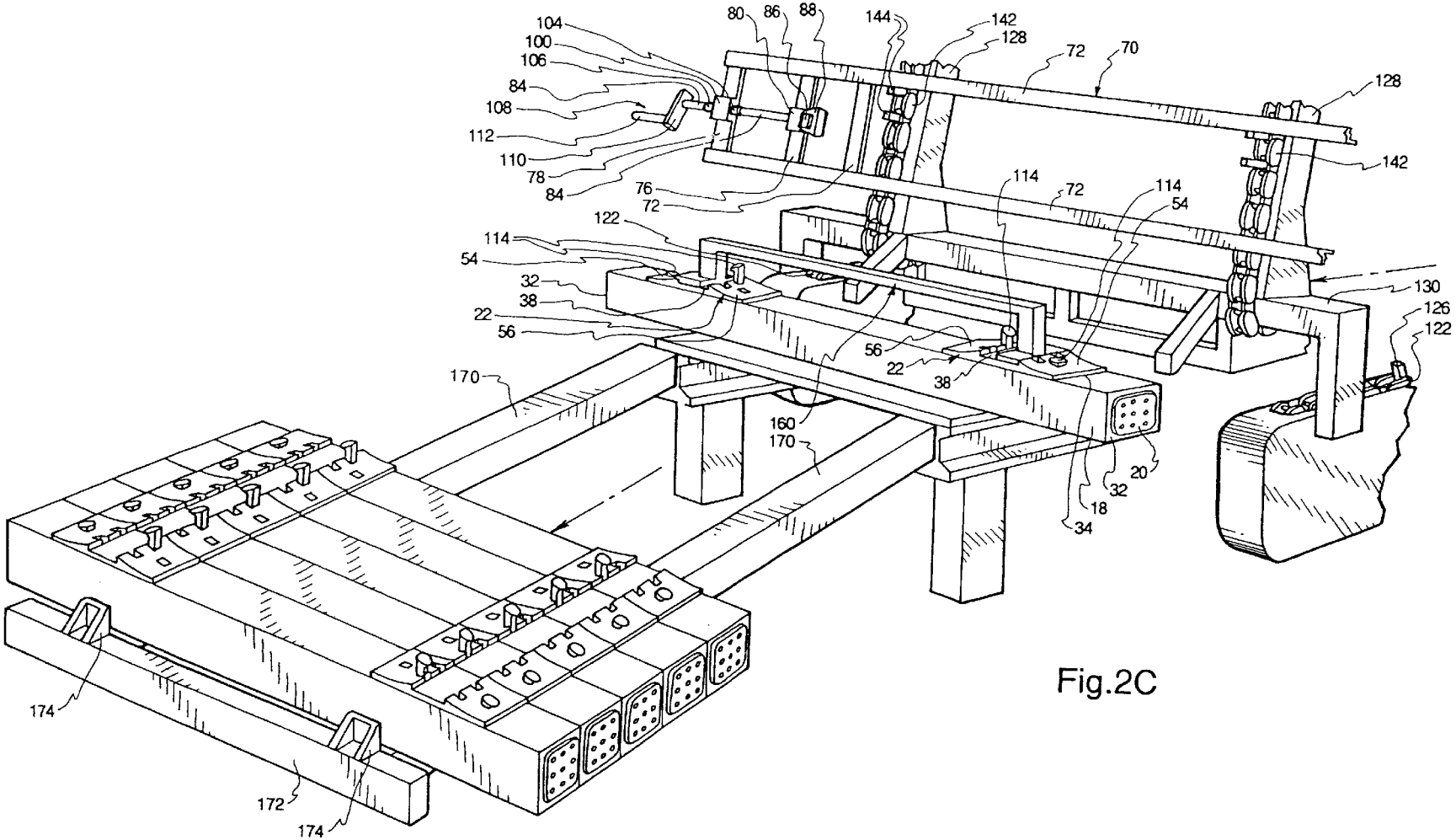

Reference is now made to FIG. 7, which illustrates another clamping mechanism which may be used to form part of the above-described jig 70, in lieu of the crank mechanisms. Specifically, a pneumatic or hydraulic cylinder may be mounted upon cross bar 78 (or cross bar 76) as by welding at site 80. The orientation of the cylinder is sloped somewhat downward from left to right. The cylinder 182 is conventional and comprises a piston rod 184 which is reciprocated, the direction of displacement depending upon whether a piston within the cylinder 182 is being advanced or retracted. A clamping block 186 is welded or otherwise secured rigidly to the distal end of the piston rod 184 so that clamping block 186 engages the edge surface 134 of the adjacent plate 22 when advanced to cause the plate surface 50 to forcibly and contiguously engage the associated cross bar 74 of the jig.

The invention may be embodied in other specific forms without departing from the spirit of the essential characteristics thereof. The present embodiments, therefore, are to be considered in all respects as illustrative and are not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of pre-plating railess ties, comprising the acts of:

placing two generally planar plates on top of each of a sequential number of railess wooden railroad ties each having a generally smooth top surface;

positioning the two plates associated with each railroad tie with a plate-locating removable jig which engages the tie and the two plates;

displacing a field spike through an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later to later receive thereunder a base flange of a railroad rail;

the placing and positioning acts taking place at a stationary work station remote front railroad rails.

2. A method of pre-plating railess railroad ties, comprising the acts of:

placing two generally planar plates on top of each of a sequential number of railess wooden railroad ties each having a generally smooth top surface;

positioning the two plates associated with each railroad tie with a plate-locating removable jig which engages the tie and the two plates;

displacing a field spike through an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

the displacing acts taking place at least in part as ties are successively conveyed past a work station remote from railroad rails.

3. A method of pre-plating railess railroad ties, comprising the acts of:

placing two generally planar plates on top of each of a sequential number of railess wooden railroad ties each having a generally smooth top surface;

positioning the two plates associated with each railroad tie with a plate-locating removable jig which engages the tie and the two plates;

displacing a field spike trough an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

displacing acts each comprising manually starting each spike through an aperture in its associated wooden plate into its associated tie at a stationary work station at which a rail is not present and machine driving each spike a further distance into the associated wooden tie as the tie is conveyed past another work station at which a rail is not present.

4. A method of pre-plating railess railroad ties, comprising the acts of:

placing two generally planar plates on top of each of a sequential number of railess wooden railroad ties each having a generally smooth top surface;

positioning the two plates associated with each railroad tie with a plate-locating removable jig which engages the tie and the two plates;

displacing a field spike through an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

handling the completed pre-plated ties selected from the group consisting of transporting completed pre-plated ties to a storage location and shipping completed pre-plated ties to a remote railroad site.

5. A method of pre-plating railess railroad ties, comprising the acts of:

placing two generally planar plates on top of each of a sequential number of railess wooden railroad ties each having a generally smooth top surface;

positioning the two plates associated with each railroad tie with a plate-locating removable jig which engages the tie and the two plates;

displacing a field spike through an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

removing the tie and plate engaging jigs from the associated completed pre-plated railess ties and reusing each jig to further practice the positioning act on another tie;

returning each removed jig from a downstream site to an upstream site after the removing act and before the reusing act;

the returning act comprising sequentially conveying the removed jigs from the downstream site, over a work station where the displacing acts are practiced to an upstream site where the positioning act is practiced on another tie.

6. A method of pre-plating railess railroad ties, comprising the acts of:

placing two generally planar plates on top of each of a sequential number of railess wooden railroad ties each having a generally smooth top surface;

positioning the two plates associated with each railroad tie with a plate-locating removable jig which engages the tie and the two plates;

displacing a field spike through an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

removing the tie and plate engaging jigs from the associated completed pre-plated railess ties and reusing each jig to further practice the positioning act on another tie;

returning each removed jig from a downstream site to an upstream site after the removing act and before the reusing act;

the returning act comprising sequentially conveying the removed jigs from the downstream site, over a work station where the displacing acts are practiced to an upstream site where the positioning act is practiced on another tie;

the sequentially conveying act comprising moving the jigs to be reused consecutively along a conveyor up and over the work station.

7. A method of pre-plating railess railroad ties, comprising the acts of:

placing two generally planar plates on top of each of a sequential number of railess wooden railroad ties each having a generally smooth top surface;

positioning the two plates associated with each railroad tie wit a plate-locating removable jig which engages the tie and the two plates;

displacing a field spike through an aperture in a field side of each plate into its associated wooden tie until a head of each field spike is contiguous wit its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

the positioning act comprising engaging an inside surface of a field flange of both of two plates on top of each tie and one end of the tie with stops of the associated jig.

8. A method of pre-plating railess railroad ties, comprising the acts of:

placing two generally planar plates on top of each of a sequential number of railess wooden railroad ties each having a generally smooth top surface;

positioning the two plates associated with each railroad tie with a plate-locating removable jig which engages the tie and the two plates;

displacing a field spike through an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

the positioning act comprising engaging an inside surface of a field flange of both of two plates on top of each lie and one end of the tie with stops of the associated jig;

the engaging act comprising clamping a field edge and the inside surface of the field flange of each tie-engaging plate between clamping components, at least one of which comprises one of said stops.

9. A method of pre-plating railess railroad ties, comprising the acts of:

placing two generally planar plates on top of each of a sequential number of railess wooden railroad lies each having a generally smooth top surface;

positioning the two plates associated with each railroad tie with a plate-locating removable jig which engages the tie and the two plates;

displacing a field spike through an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

the positioning act comprising engaging an inside surface of a field flange of both of two plates on top of each tie and one end of the tie with stops of associated jig;

the engaging act comprising clamping a field edge and the inside surface of the field flange of each tie-engaging plate between clamping components, at least one of which comprises one of said stops;

the clamping act comprising tightening two plate-engaging components, causing the jig to contiguously engage the field edge and the inside surface of the field flange of each tie-engaging plate.

10. A method of pre-plating railess railroad ties, comprising the acts of:

placing two generally planar plates on top of each of a sequential number of railess wooden railroad tics each having a generally smooth top surface;

positioning the two plates associated with each railroad tie with a plate-locating removable jig which engages the tie and the two plates;

displacing a field spike through an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

the positioning act comprising engaging an inside surface of a field flange of both of two plates on top of each tie and one end of the tie with stops of the associated jig;

the engaging act comprising clamping a field edge and the inside surface of the field flange of each tie-engaging plate between clamping components, at lest one of which comprises one of said stops;

the clamping act comprising tightening two plate-engaging components, causing the jig contiguously engage the field edge and the inside surface of the field flange of each tie-engaging plate;

the clamping act comprising displacing one plate-engaging component towards the other plate-engaging component.

11. A method according to claim 10 wherein the displacing act comprises use of an eccentric crank arm, a threaded shaft and at least one threaded fitting to generally linearly move the one plate-engaging component towards the other plate-engaging component when the eccentric crank arm is turned.

12. A method of pre-plating railess railroad ties, comprising the acts of:

placing two generally planar plates on top of each of a sequential number of railess wooden railroad ties each having a generally smooth top surface;

positioning the two plates associated with each railroad tie with a plate-locating removable jig which engages the tie and the two plates;

displacing a field spike through an aperture in a field side of each plate into its associated wooden tie until a head of each field spike is contiguous with its associated plate to secure each plate to the associated tie;

displacing a gauge spike through an aperture in a gauge side of each plate into its associated wooden tie until a head of each gauge spike is disposed at a distance above the plate ample to later receive thereunder a base flange of a railroad rail;

the positioning act comprising engaging an inside surface of a field flange of both of two plates on top of each tie and one end of the tie with stops of the associated jig;

the engaging act comprising clamping a field edge and the inside surface of the field flange of each tie-engaging plate between clamping components, at least one of which comprises one of said stops;

the clamping act comprising tightening two plate-engaging components, causing the jig to contiguously engage the field edge and the inside surface of the field flange of each tie-engaging plate; the clamping act comprising displacing one plate-engaging component towards the other plate-engaging component;

the displacing act comprising use of pneumatic or hydraulic cylinder to generally mineral move the one plate-engaging component towards the other plate-engaging component.

* * * * *